US006257295B1

(12) United States Patent
Small

(10) Patent No.: US 6,257,295 B1
(45) Date of Patent: Jul. 10, 2001

(54) BUTTON SHANK WRAPPING MACHINE

(76) Inventor: Mason Simon Small, 50 Hall Rise, Bramhope, Leeds LS16 9JG (GB)

( * ) Notice: Subject to any disclaimer, the term of this patent is extended or adjusted under 35 U.S.C. 154(b) by 0 days.

(21) Appl. No.: 09/254,459

(22) Filed: Mar. 4, 1999

(51) Int. Cl.[7] ..... D05B 3/16

(52) U.S. Cl. ..... 156/443; 156/494; 2/265; 223/1; 112/108

(58) Field of Search ..... 156/169, 172, 156/175, 425, 443, 494; 2/265; 223/1; 112/108, 110

(56) References Cited

FOREIGN PATENT DOCUMENTS

95/33880 * 12/1995 (WO) ..... D05B/97/10

97/04674 * 2/1997 (WO) ..... A41H/43/00

* cited by examiner

*Primary Examiner*—Michael W. Ball
*Assistant Examiner*—Jessica Rossi
(74) *Attorney, Agent, or Firm*—James L. Jackson, Esq.; Mayor, Day, Caldwell & Keeton, L.L.P.

(57) ABSTRACT

A machine has a support (3) which receives and supports a button shank (6) at a support station (4); a winding device (12) rotates thread (21) through an outlet (25) to wind it around the shank supported in the support under the control of tensioner (17); hooks (56, 57) catch the thread at both ends after bonding the winded thread, the hooks moving as a unit (77) snap the thread to release the shank from the support.

10 Claims, 7 Drawing Sheets

80
1
37
40
2
21
22
16
17
19
20
35
18
5
65
3
7
75
122
57
75
56
B
77
42
C
46
47
74

BUTTON SHANK WRAPPING MACHINE

The present invention relates to a button shank wrapping machine and to a method for wrapping the shank of a button. Wrapping a shank is also known as whipping the shank.

In order to secure a coat button it is conventional to pass thread through the holes of the button from the coat material several times. The accumulated thread between the button and coat forms the button shank which is then finished off by winding the free end of the button thread around the shank so as to whip it. The free end is then secured in the coat material. This has normally been done by hand. However, button sewing machines are known and so are shank whipping machines but there are problems with securing the ends of the thread.

Thus a button shank whipping machine according to the invention comprises a support adapted to receive and support a button shank at a support station, winding means to wind thread around the shank, tensioning means to apply tension to the thread as it is wound, means to supply thread to the winding means, means to form a bond on the shank adjacent to the support station, the winding means having a thread outlet offset from the shank support station, and wherein the outlet is rotatable for winding about a winding axis aligned with the button support.

The offsetting of the thread outlet allows shank bonding either by heat fusing or by applying a bonding agent to the shank.

The winding means may be fed with thread from a supply either partly along the winding axis in one embodiment or from a supply offset from the winding axis in a second embodiment.

In one embodiment the button is supported against an axial movement in a separate support from the shank support. This enables tension to be applied between the button and the material to which it is sewn which improves winding formation.

In a surprise version of the above embodiment tension is applied manually by pulling gently on this object to which the button is sewn. In a further version tension is applied by means of a tensioning means suitably a piston and cylinder arrangement, acting preferably through a link to the separate support for the button, the link being substantially aligned at least in part with the winding axis.

In order to ensure heat fusing a heatable fusing iron is arranged to be moveable into momentary engagement with the shank after whipping.

In order to ensure that one end of this thread is held during the winding operation, it would be possible to manually twist the free end of the sewing thread used to sew the button on to the object to be buttoned on to the free end of the whipping thread. These would subsequently be fused or bonded together after whipping. However, in order to provide automatic control and consistency in production it is preferred to provide a first catching element arranged to hold the free end of the whipping thread whilst applying tension on the whipping thread and winding the thread around the shank. After whipping is completed, a second catching element is arranged to catch the whipping thread between the whipped shank and tensioning means, a control unit provided for this embodiment then moves the fusing iron on to the shank and then both catching elements are moved away from the button to snap both ends of the whipping thread, releasing the button and object to be buttoned for removal from the machine or for relocation at another position.

In a method of whipping a button shank of a button sewn to an object according to the invention the button and object are supported at a support station, thread is supplied to the shank and is wound around the shank under tension to whip the shank, the thread is then broken off to release the button and object.

Preferably the thread is caught and held by a first catching element before winding the thread and is caught and held again by a second catching element after completion of the winding step and after bonding of fusing the wound thread. Both catching elements are then moved away from the shank to break the thread at the start and finish of the winding. The first catching element is controlled to release the portion of thread in its grasp whilst the second catching element retains the supplied thread ready for the next whipping operation.

The dual catching arrangements ensure that the machine when fully supplied with thread is always ready again for the next button whipping.

Embodiments of the invention will now be described by way of example with reference to the accompanying drawings in which.

Figure 1:
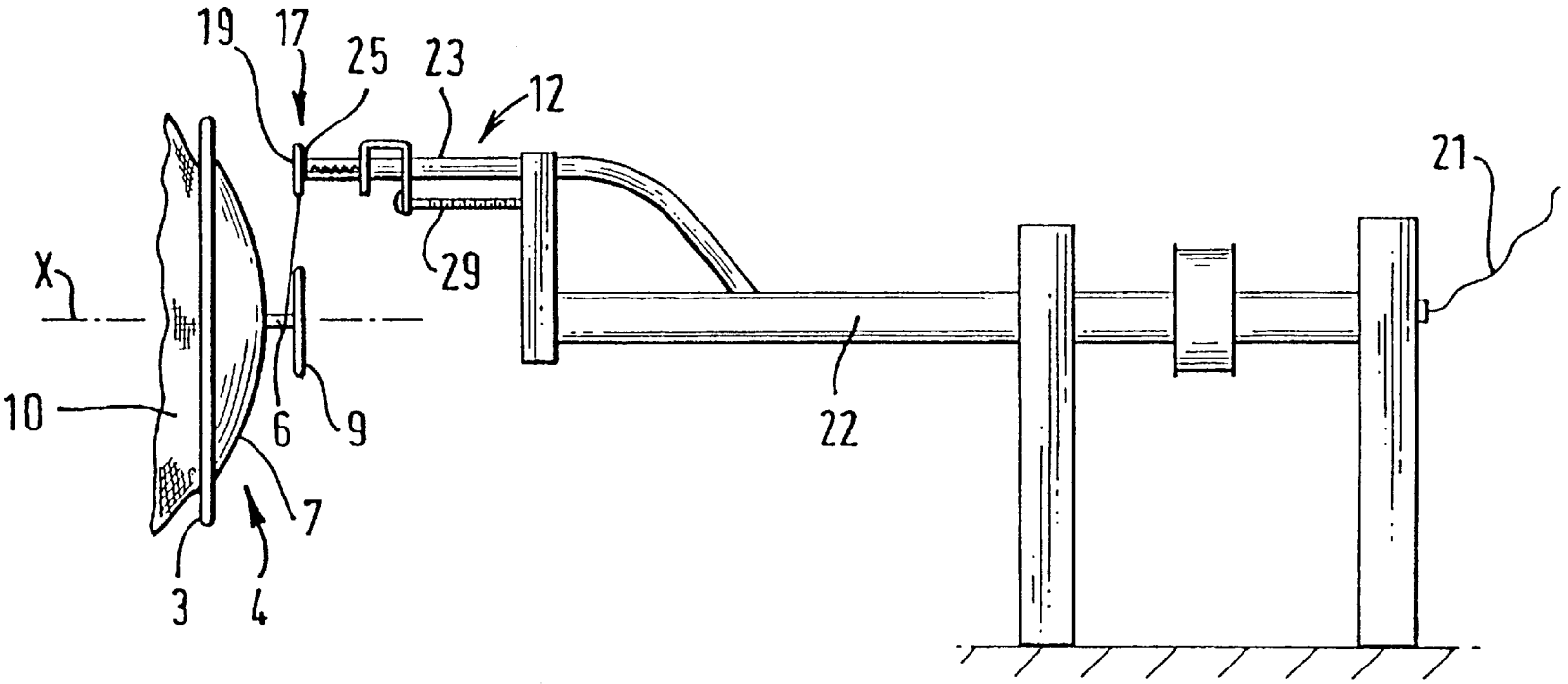
FIG. 1 is diagrammatic side view of a first embodiment of a button shank whipping machine according to the invention.

Referring to FIG. 1, a simple button shank whipping machine according to a first embodiment is shown. The machine has a whipping plate (3) which provides a support to receive and support at a support station (4) a button shank (6) extending from a button (9) to a garment (10) (only partly shown) such as a coat.

The whipping plate (3) has a slot (5) (see FIG. 5) to accept the shank (6) which has been formed from several strands of thread at the button sewing stage. The domes portion (7) ensures whipping thread (21) has a clear run when being wound round the shank (6).

The winding means (12) comprising a rotatable tube (22) from which extends a cranked extension tube (23) whose outlet (25) is offset from the winding or whipping axis X. In the outlet (25) is a tensioning means (17) shown in detail in FIG. 8. The tensioning means (17) comprises a tension cap (19) which is urged towards outlet (25) by two springs (26) whose tension can be adjusted by screw (29). Having previously secured one end of thread (21), as tube (22) is rotated (in a very simple arrangement manually), so thread (21) is pulled from its supply (not shown) and under tension of tensioner (17) around shank (6). The thread in a simplest arrangement can be twisted around an end of the shank thread.

Figure 2:
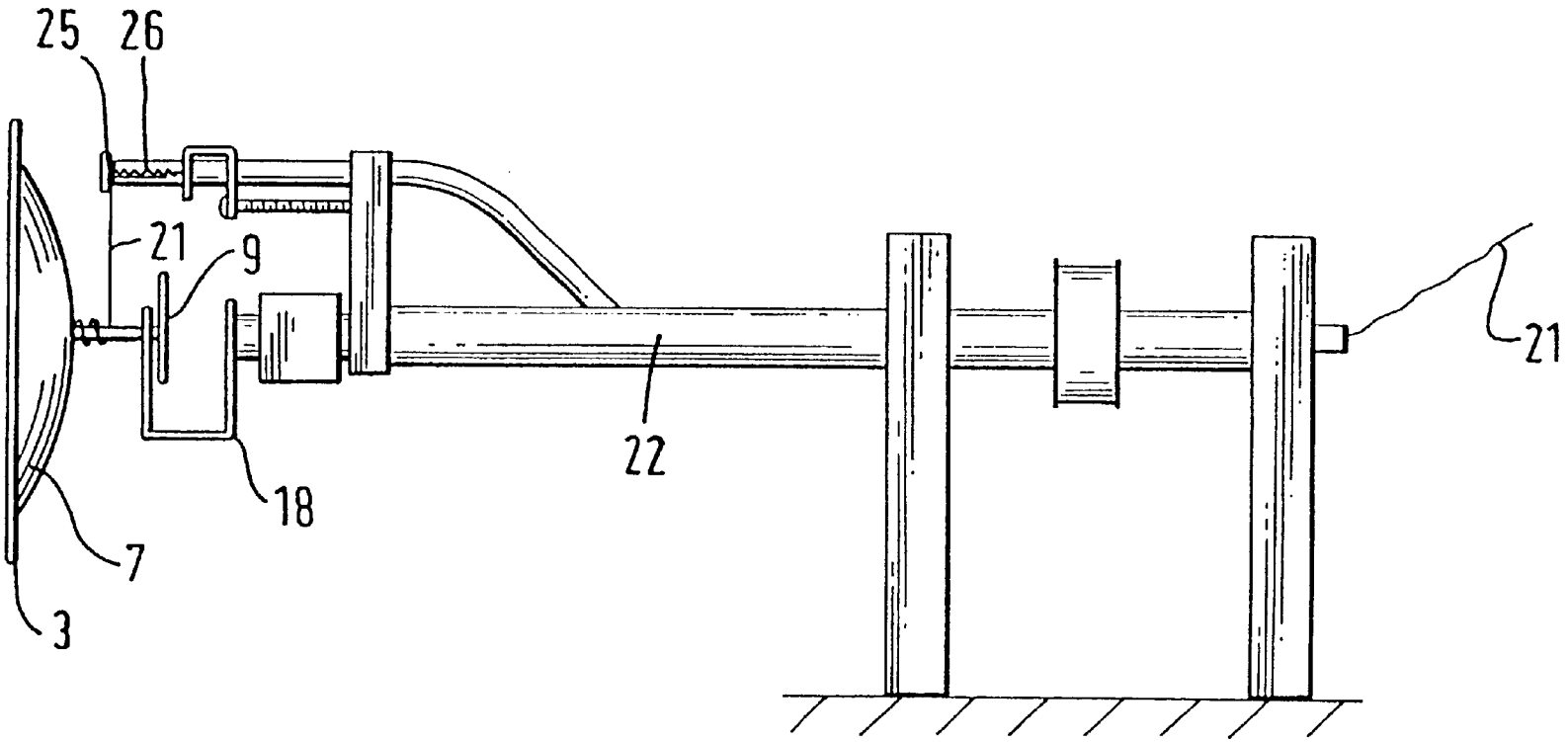
FIG. 2 is a similar side view of a second embodiment of a medium according to the invention with button support.

In the second embodiment shown in FIG. 2, the shank (6) is held under tension by providing a button support (18). This is essentially a 'U' shaped plate, one upright web being slotted at (20) to receive the shank (6). The button support

Figure 3:
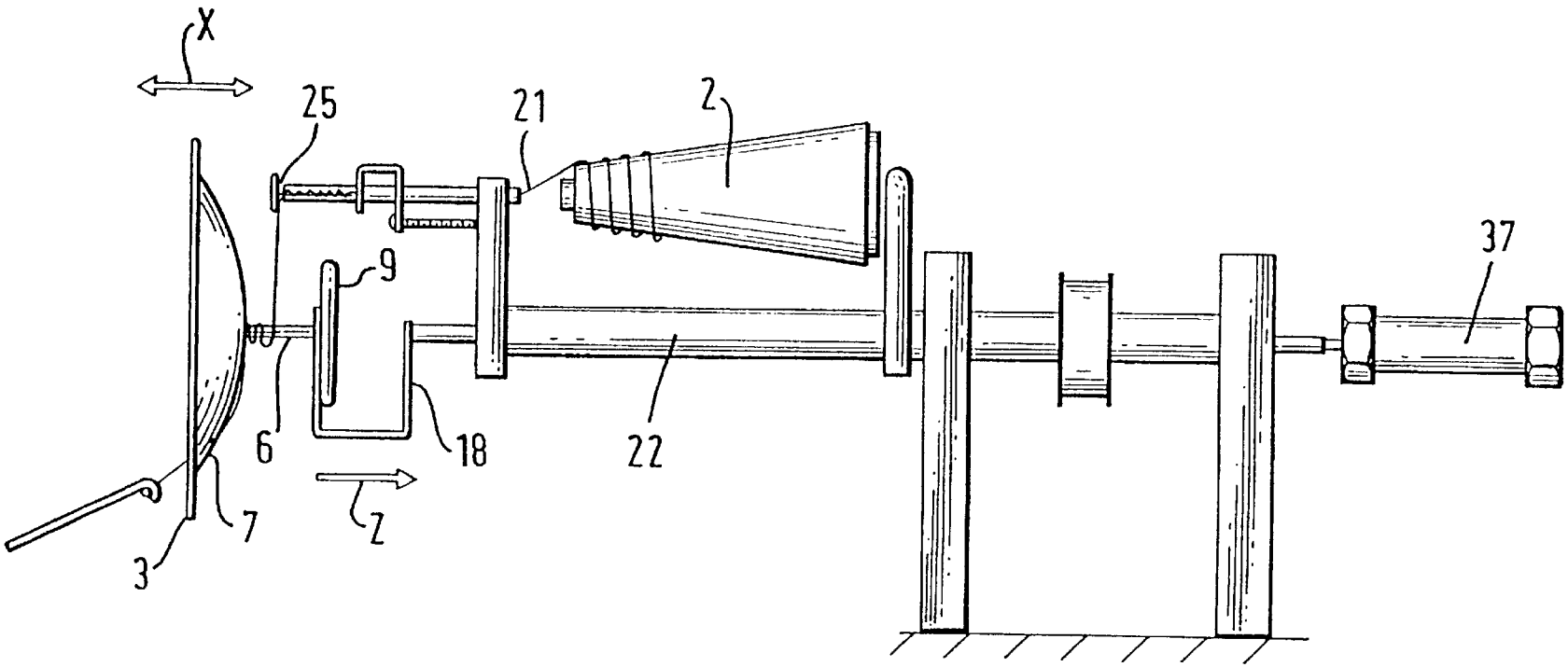
FIG. 3 is a similar side view of a third embodiment of the invention with rotatable thread supply and button tensioning.
Figure 5:
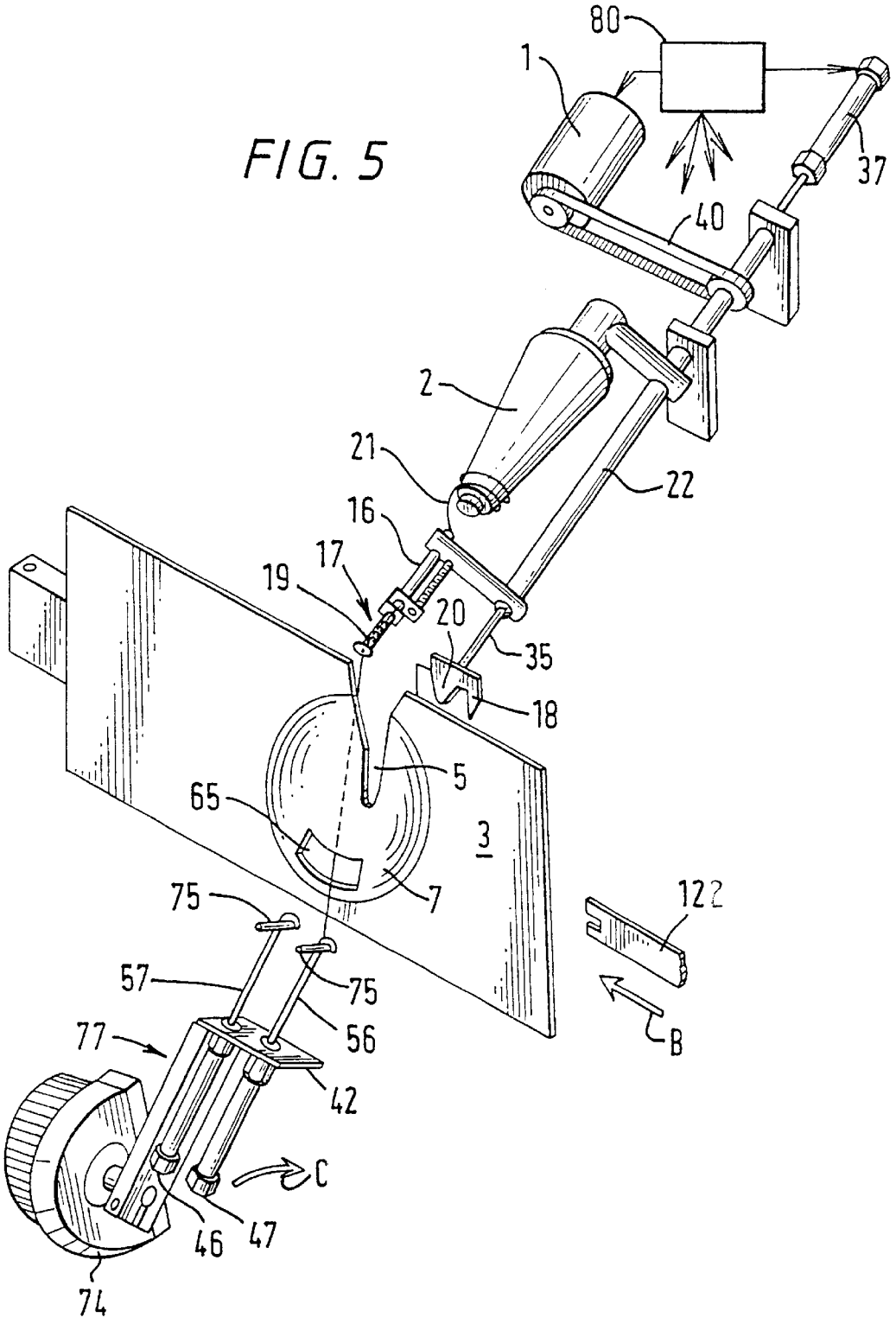
FIG. 5 is a perspective view of the third embodiment shown in FIGS. 3 and 4 showing thread catching arrangements.
Figure 6:
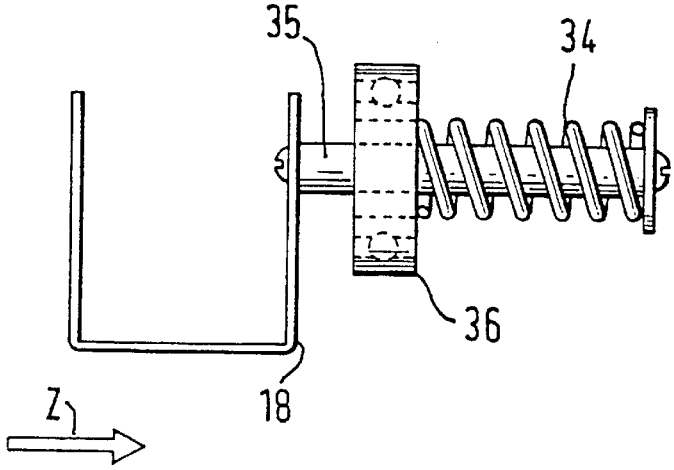
FIG. 6 is a detail of button support arrangements for the second embodiment shown in FIG. 2.

(18) is pulled away from whipping plate (3) in direction Z as shown in FIG. 3 by a spring (34) acting on bearing (36) in the simpler version shown in FIG. 6 or by an actuator (37) which acts on rod (35) which extends through tube (22) to be secured to support (18). (See FIGS. 3—5).

Figure 4:
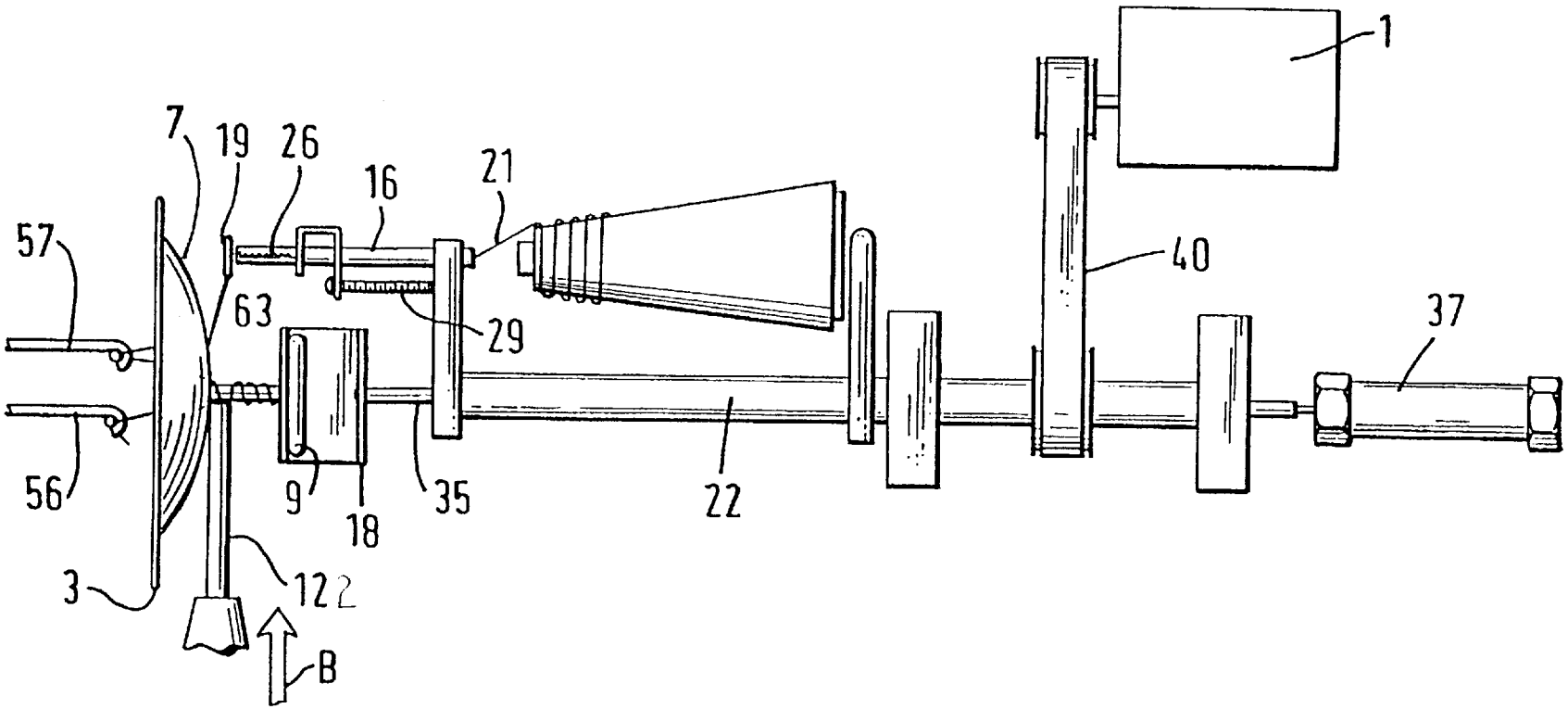
FIG. 4 is a top view of the third embodiment shown in FIG. 3 after the winding is complete.
Figure 8:
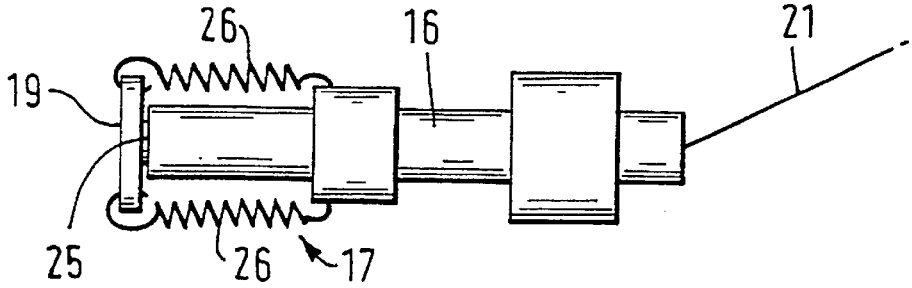
FIG. 8 is a detail of thread tensioning arrangements for all the embodiments shown in FIGS. 1 to 7.
Figure 7:
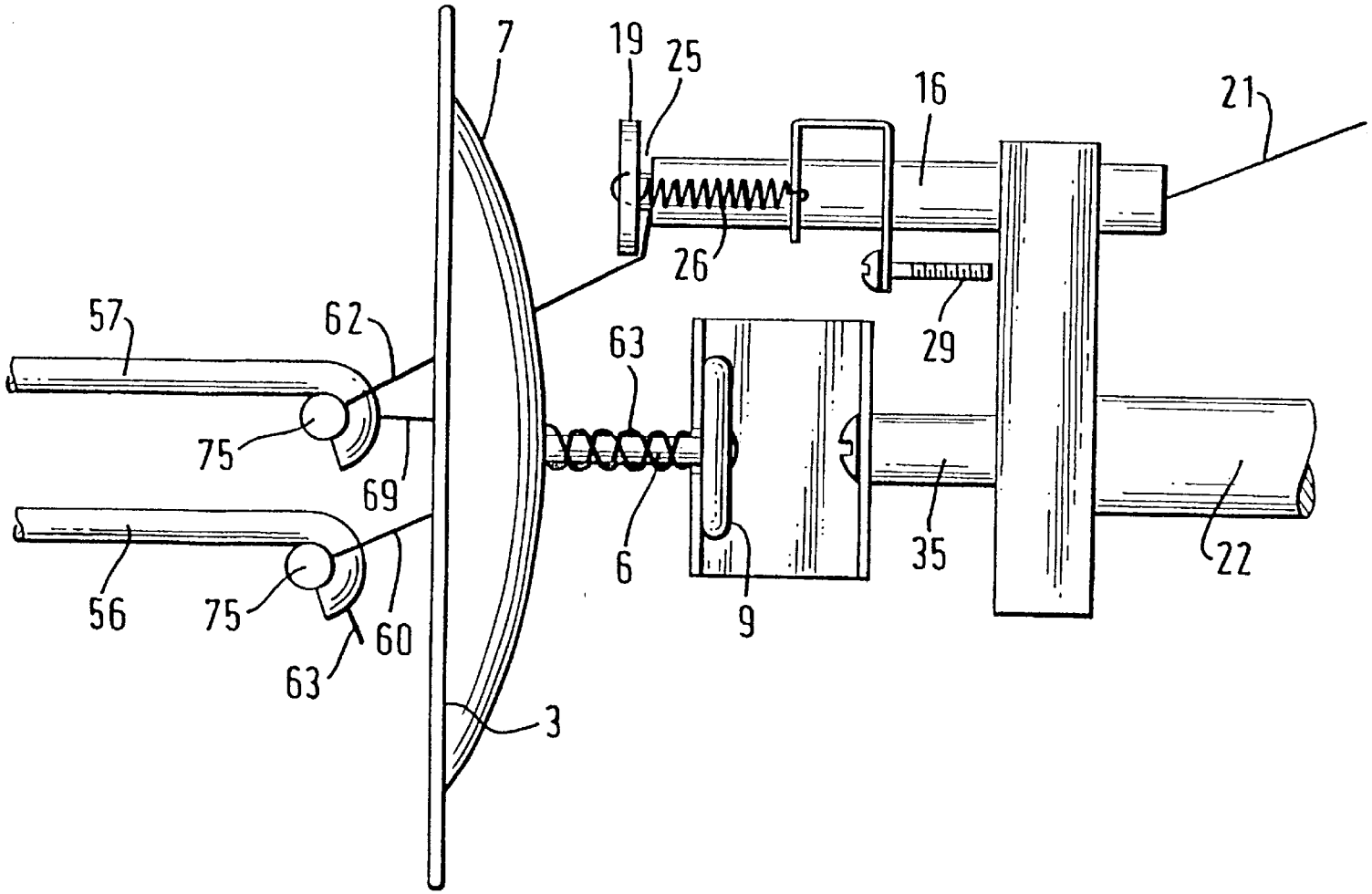
FIG. 7 is a detail of thread catching arrangements for the embodiment shown in FIGS. 3 to 5.

In the fully automated third embodiment shown in FIGS. 3 to 5 and in two details in FIGS. 7 and 8 an electric motor, having a positioning and stopping control system is arranged to rotate by means of belt (40), tube (22), on which is mounted a thread cone (2) forming a thread supply for thread (21), a thread tube (16) offset from winding axis X which is also the axis of tube (22). At the end of tube (16) is tensioning cap (19) Mounted on bracket (42) on the other side of plate (3) to the button support (18) are a pair of actuators (46) and (47) (see FIG. 5). These actuators cause hooks (56) and (57) respectively to catch and hold one end (60) of thread (21) before winding around the shank and then to catch and hold a portion or bight (62) of the thread between winding or whipping (63) around shank (6) and tension caps (19). This is best seen in FIG. 7.

The hooks (56) and (57) are caused to reciprocate through slot (65) in bell portion (7) of plate (3) so as to catch the thread and to hook it back to be clamped against pins or stop bars (75).

Both actuators (46) and (47) on bracket (42) are caused to move away from the button support (18) by means of a rotatory actuator (74) to snap thread (21) after the completion of the whipping operation and fusing the thread by hot fork (122) which is mounted to the machine frame for reciprocating movement in direction B and away from shank (6).

The third embodiment operates as follows:

At the start of the whipping cycle the end (60) of thread (21) is clamped between either hook (56) or (57) and a bar (75) (in the drawings it is clamped initially between hook (56) and bar (75). The garment or object (10) with its button (9) and button shank (6) is presented to whipping plate (3) with the button in support (18) in such a manner that the shank slides down to the bottom of slot (5) in the plate (3). The operator then initiates the whipping cycle by pressing a button or foot control.

On commencement of the automatic cycle the motor (1) spins the thread cone (2) together with the thread tube (16) and the tension cap (17) for a specifically required number of revolutions. This winds or wraps thread around the shank. After the required number of wraps have been completed the hook clamp (57) is moved to a forward position inside the rotational circumference of outlet (25) or the thread tube (16) when this tube is at a predetermined angular position. A further amount of angular rotation of the thread cone and tube then takes place causing the whipping thread to be caught by the hook clamp. The motor is then stopped. The hook clamps (56) and (57) are then returned to the rest position as shown in FIG. 7 the pulling with it the whipping thread until this thread is clamped between the hook and the stop bar (75) (15).

As shown in FIG. 4 a hot fork (122) then moves in direction B until it is in contact with the newly wrapped shank. It remains in this position for the amount of time which is necessary to bond the whipping threads to prevent subsequent unravelling. The hot fork is then automatically moved to its previous rest position away from a position where it could interfere with the cycle. This is only one type of bonding method, other types exist and could be used such as applying a bonding substance or glue to the wrapped threads.

As illustrated in FIG. 3 the two hook clamps (56, 57) are arranged in such a way so that they can be moved with actuators (46, 47) as a complete unit (77) on bracket (42) further away from the button support (18) by such a distance so as to break off the threads from the whipped shank. This break takes place at the shank due to the weakening of the thread caused by the previous heating or bonding operation. In FIG. 5 it can be seen that in this case this motion is accomplished by moving the hook clamp unit in a rotary motion in a direction C. With this hook clamp unit (77) in its furthermost position away from the button support hook (56) is automatically moved to the open position thus releasing the broken away piece (63) of whipping thread. This ejection of the waste thread can be assisted by an air blower. The hook (56) then returns to its closed position before the hook clamp unit returns to its position closest to the wrapping position. The bight (62) of the thread now ending at (69) which emanates from the outlet (25) of the thread tube (16) remains clamped in the hook clamp (57) ready for the next cycle.

During subsequent operations the hook clamps work in an alternative opening and closing sequence as is necessary to clamp and catch the whipping thread.

Where buttons have short shanks it may not be necessary to provide a button support (18), the button being supported on its shank in support plate (3). Another feature of this invention is a mechanism which allows for buttons which require supporting because, for example, they have long shanks. Referring to FIG. 3 it can be seen that the button (9) is supported by the button support (18). Upon commencement of the automatic whipping cycle the first motion is for the button support to move from its rest position next to the whipping plate (3) in direction Z until its motion is stopped by the threads attaching the button to the garment. The force which acts on the button in direction X is as low as possible in order to hold its shank straight and is, in this case, provided by a pneumatic actuator (40) although any method of applying force could be used. The wrapping cycle then commences. It is often desirable to wrap the button shank neatly along its total length. This embodiment provides for this requirement by moving the whipping plate (3) in a controlled manner backwards and forwards in both directions of the arrow X during the whipping process. The force is always maintained on the button in direction Z during this process as the force moving the whipping plate (3) is greater than that acting on the button in direction Z.

During subsequent operations the hook clamps work in an alternate opening and closing sequence as is necessary to clamp and catch the whipping thread.

FIG. 5 shows a less sophisticated method of supporting the button during wrapping.

This method has the same button support (18), which is fastened to an axle (25) which is supported and able to slide through a bearing (36). Spring (34) maintains a force in direction Z on the button. This method of supporting the button relies on gravity acting on the heavier side of the button support (18) and consistently low friction in the bearing (36) to prevent the rotating motion of tube (22) from spinning the button during the wrapping cycle. The alternative previously described method shown in FIGS. 1 to 3 however has the advantage of precise control from the fixed actuator (37).

While this invention has been illustrated and described in accordance with several embodiments and a preferred embodiment, it is recognised that variations and changes may be made therein without departing from the invention as set forth in the claims.

What is claimed is:

1. A button shank whipping machine comprising a shank support (3), adapted to receive and support a button shank (6) at a support station (4), including a winding element (12) to wind thread (21) around the button shank, said winding element having an elongate rotatable element (22) and a crank tube (23) fixed to the rotatable element (22) and being in laterally offset relation to said rotatable element and defining a thread passage through which thread (21) is moveable to wind thread (21) around the button shank, tensioning means (17) to apply tension to the thread as it is wound, means (2,22) to supply thread to the element tube of the winding crank, wherein the crank tube of the winding element (12) has a thread outlet (25) being laterally offset from the shank in its supported position, and wherein the outlet (25) of the crank tube is rotatable for winding about a winding axis (X) aligned with the button shank support and shank bonding means (122) being arranged to bond the whipped thread on the shank.

2. The machine of claim 1 wherein the supply means (2) is offset from the winding axis (X).

3. The machine of claim 1 wherein the supply means (22) is located at least partially along the winding axis (X).

4. The machine of claims 1 or 2 wherein a button support (18) is provided and is so arranged to apply tension force to the shank in a direction (Z) away from the shank support (3).

5. A button shank whipping machine comprising a shank support (3), adapted to receive and support a button shank (6) at a support station (4), including winding means (12) to wind thread (21) around the shank, tensioning means (17) to apply tension to the thread as it is wound, means (2,22) to supply thread to the winding means, the winding means (12) having a thread outlet (25) offset from the shank in its supported position, and wherein the outlet (25) is rotatable for winding about a winding axis (X) aligned with the button shank support, a button support (18) arranged to tension the shank in a direction (Z) away from the shank support (3), shank-bonding means (122) arranged to bond the thread on the shank, and a pair of catching elements (56–57) are provided which are arranged to move by actuators (46–47) from positions in the region circumscribed by the movement of the thread outlet (25) to withdrawn positions away from the button support to thread clamping positions (75).

6. The machine of claim 5 wherein both catching elements are mounted together in a unit (77) to a moveable frame (42), the unit (77) being moveable by further actuator (74) to break the threads caught in the catching elements (56–57).

7. A machine as claimed claim 1 wherein a fusing means (122) is arranged to be moveable into fusing relation with the whipped thread of the shank (6) at the support station to fuse the whipped thread on the shank.

8. A method of whipping a button shank (6) of a button (9) secured to an object (10), comprising the steps of supporting the button and object at a support station, applying tension force to the button and button shank in a direction away from the support station, supplying thread (21) to the shank (6) between the button and the object by means of a winding element (12), said winding element having an elongate rotatable element (22) and a crank tube (23) fixed to said rotatable element and being in laterally offset relation to said rotatable element which is located along a winding axis (X) along which said button shank is located, the crank tube having a thread outlet, winding the thread around the shank under tension of a tension element located at the thread outlet to whip the shank, and breaking the thread to release the button and the object.

9. The method of whipping a button shank (6) as claimed in claim 8 wherein the thread is caught and held by a catching element (56, 57) before winding the thread, wherein the thread is then wound around the button shank, wherein the thread is then caught between the button shank and the thread outlet (25) of the crank tube (23) with hook means (56–57) and held, and wherein the wound thread is then bonded to the button shank.

10. The method of whipping a button shank as claimed in claim 9 wherein the thread is then broken at both ends of the winding of the thread to release the button and object.

* * * * *

UNITED STATES PATENT AND TRADEMARK OFFICE

CERTIFICATE OF CORRECTION

PATENT NO. : 6,257,295 B1
DATED : July 10, 2001
INVENTOR(S) : Mason Simon Small

It is certified that error appears in the above-identified patent and that said Letters Patent is hereby corrected as shown below:

Column 1,
Line 2, insert the following:
-- Priority in International Application No. PCT/GB97/02316 of Mason Simon Small, filed 28 August 1997 is claimed under 35 U.S.C. §365. --

Signed and Sealed this

Ninth Day of September, 2003

JAMES E. ROGAN
*Director of the United States Patent and Trademark Office*